United States Patent [19]

Seiter

[11] 4,421,825

[45] Dec. 20, 1983

[54] PAPERBOARD COATED TO MINIMIZE BROWNING

[75] Inventor: George M. Seiter, Minneapolis, Minn.

[73] Assignee: Champion International Corporation, Stamford, Conn.

[21] Appl. No.: 487,711

[22] Filed: May 2, 1983

Related U.S. Application Data

[63] Continuation of Ser. No. 334,586, Dec. 28, 1981, abandoned.

[51] Int. Cl.[3] ..... B32B 23/00; B32B 23/08

[52] U.S. Cl. ..... 428/332; 427/395; 427/411; 427/419.2; 428/352; 428/514; 428/913

[58] Field of Search ..... 428/332, 352, 511, 514, 428/913; 427/411, 419.2, 295

[56] References Cited

U.S. PATENT DOCUMENTS

| | | | |
|---|---|---|---|
| 2,889,299 | 6/1959 | Ritson | 428/514 |
| 3,297,615 | 1/1967 | Frazier et al. | 428/510 |
| 3,365,410 | 1/1968 | Wesslau et al. | 428/514 |

*Primary Examiner*—Paul J. Thibodeau
*Attorney, Agent, or Firm*—Evelyn M. Sommer

[57] ABSTRACT

The browning of paperboard subjected to temperatures of up to about 205° C. is minimized by applying to the paperboard a first coating comprising titanium dioxide and an acrylic copolymer and one or more over-coatings comprising a clear acrylic copolymer.

10 Claims, No Drawings

PAPERBOARD COATED TO MINIMIZE BROWNING

This application is a continuation of application Ser. No. 334,586, filed Dec. 28, 1981, now abandoned.

BACKGROUND OF THE INVENTION

This invention relates to paperboard coated so that browning is minimized when the paperboard is subjected to temperatures of up to about 205° C. (400° F.). It also relates to methods for minimizing such browning by applying certain coatings to the paperboard.

It is common practice to package convenience foods in disposable cooking or heating utensils which also can, if desired, serve as an eating receptacle or plate. Until the advent of microwave ovens for use in home kitchens, the most common containers for convenience foods to be heated within the container were formed of thin sheet aluminum or layers which included aluminum foil. However, because aluminum cannot generally be used in microwave cooking—and, also, because of the relatively high cost of aluminum as opposed to paperboard—paperboard containers for such convenience foods have become increasingly popular.

Convenience foods may, for example, be precooked and packaged in containers and then reheated. The containers in which such foods are packaged must therefore be capable of withstanding the food heating operation without causing any adverse effects on the food or the package itself. The containers, therefore, must be capable of being subjected to temperatures of up to about 176°-205° C. (about 350°-400° F.) Furthermore, since many convenience foods are frozen, the container must also be able to withstand low temperatures in the range of about −24° C. (about −10° F.). Paperboard containers for such food products coated with various polymeric plastic substances are well known in the art and, in many instances, such containers are able to withstand these high and low temperatures. For example, U.S. Pat. No. 3,813,256 discloses food heating utensils comprising paperboard coated with polyphenylene oxide or polysulfones. U.S. Pat. No. 3,904,104 and U.S. Pat. No. 4,147,836 disclose such paperboard products coated with polypropylene or polyester.

Despite the wide spread use of coated paperboard in the food packaging industry, there remains the problem of paperboard browning at temperatures exceeding about 150° C. (302° F.). Although such containers may retain their utilitarian function despite the browning, there are obvious esthetic disadvantages, particularly when the container is also intended for use as an eating utensil.

SUMMARY OF THE INVENTION

The coated paperboard formed in accordance with this invention has a plurality of distinct coatings. There is first applied to the paperboard a coating solution comprising titanium dioxide and an acrylic copolymer dissolved in an organic solvent. After drying this first coating, one or more overcoatings of clear acrylic copolymer is applied.

DETAILED DISCLOSURE

The use of titanium dioxide and similar finely divided inorganic materials in acrylic polymer emulsions is disclosed in U.S. Pat. No. 2,889,299 for the purpose of imparting grease resistance to paper and other cellulosic webs. In U.S. Pat. No. 3,297,615, similar emulsions containing titanium dioxide are disclosed as providing a pigmented coating of superior resistance to removal by the pulling action of ink during high speed printing. U.S. Pat. No. 3,365,410 discloses aqueous suspensions of titanium dioxide with particular mixtures of acrylic copolymers and indicates that they are useful for coating paper. It has now been discovered that the use of titanium dioxide and an acrylic copolymer dissolved in an organic solvent as a first coating, with one or more subsequent coatings of a clear acrylic copolymer, provides a paperboard composition which is highly resistant to browning at temperatures of up to about 205° C.

The paperboard used as the substrate for the coated composition can be ordinary paperboard generally used in preparing containers for convenience food. It should have a low level of contaminants which inhibit proper adhesion of coating and have sufficient surface roughness to permit strong adhesion of the coating. The coating thickness should be such that it weighs between about 1.5 and about 5 lbs. per ream, preferably about 3 lbs. per ream after having been coated, according to the methods of this invention, by coatings totaling about 1/5 mil.

The acrylic copolymers usable in this invention are well known in the art and are derived from about 10 to about 90 weight percent of esters of acrylic and/or methacrylic acids with alcohols having from 1 to 8 carbon atoms and a total of from 90 to about 10 weight percent of other monomers copolymerizable therewith. Such monomers include one or more of the following: vinyl esters of acetic and/or propionic acids; ethylenically unsaturated compounds such as the group consisting of styrene, styrene-p-sulfonic acid, vinylsulfonic acid, vinyl chloride, vinylidene chloride, ethylenically unsaturated acids having from 3 to 5 carbons atoms, the amides, alkylamides, N-methylolamides, ethers of the N-methylolamides, and esters of the said acids, acrylic and methacrylic acids; as well as other known copolymerizable substances. Examples of suitable acrylic and/or methacrylic acid esters include ethyl acrylate, methylmethacrylate, butylacrylate,2-ethylhexyl acrylate, methylacrylate, ethylmethacrylate, and the like. The preferred copolymer for use in this invention is a copolymer of styrene and methylmethacrylate.

In the process of this invention, the acrylic copolymer is dissolved in a suitable solvent such as, for example, toluene, acetone, n-hexane and other solvents known in the art.

For the first coating, the concentration of copolymer in solution ranges from about 5 to about 15 weight percent, preferably about 10 weight percent. To this is added titanium dioxide in sufficient amount to give from about 15 to about 35 weight percent of the pigment, preferably about 20 weight percent, based on weight of coating solution.

For the overcoatings, the dissolved copolymer, which is present in solution ranging from about 10 to about 20 weight percent, preferably about 16 weight percent, is used directly. For the sake of convenience, the polymer overcoating can be the identical acrylic copolymer employed in the first coating, but this is not necessary and any acrylic copolymer meeting the foregoing definition can be employed.

On top of the overcoating, there is optionally applied a release coating comprising an acrylic copolymer to which is added a release agent such as calcium stearate.

This release coating is not necessary to prevent browning on heating of the container according to this invention, but is useful in facilitating handling during storage, etc. With the release coating, the containers of this invention can be nested and readily separated. This release coating is, like the first coating and the overcoatings, applied in solution, and may for the sake of convenience, comprise the same copolymer employed in one or more of the other coatings.

All coating solutions are applied according to well known methods such as, for example, gravure coating procedures. After the first coating is applied, it should be air-dried, or oven-dried at temperatures up to about 120°-150° C. (250°-300° F.), prior to application of the over coatings. One or more over coating may be applied. Preferably 2 or 3 over coatings are employed with a drying step between each coating and before application of the optional release coating.

The following Example is intended to be merely illustrative of the present invention and not in limitation thereof.

EXAMPLE

A white coating for application to paperboard intended for use in the manufacture of an ovenable cooking or baking pan was prepared as follows.

A premix was formulated from a solution of styrene-methyl methacrylate copolymer dissolved in toluene, acetone and n-hexane having a ≈26 second viscosity, #2 Zahn and 20 parts of $TiO_2$ by blending in a high shear mixer.

In a second step the premix was blended in a ratio of 1:1 with a further quantity of the copolymer solution. The resultant blend was reduced to press viscosities using the n-hexane, acetone, toluene solvent mixture and run on the press using a gravure coating procedure.

The coating formulation as just described corresponded to the following:

| | |
|---|---|
| Titanium dioxide | 17 parts |
| Styrene-methyl methacrylate copolymer | 10 parts |
| Acetone | 50 parts |
| n-Hexane | 18 parts |
| Toluene | 5 parts |

The coating was oven dried at about 130° C. and a polymer overcoating based on the same acrylic copolymer applied and the overcoating dried.

In use with a convenience frozen food, no browning was observed to occur following heat treatment in an oven at temperature of about 205° C.

We claim:

1. A paperboard product resistant to browning at temperatures of up to about 205° C., said product comprising a paperboard substrate coated on at least one surface thereof with a plurality of distinct coatings including a first coating comprising titanium dioxide and a solution having from about 5 to 15 weight percent acrylic copolymer, said titanium dioxide being present in said first coating in amounts ranging from about 15 to about 35 weight percent of the acrylic copolymer in the first coating, and one or more overcoatings of a clear acrylic copolymer which is substantially free of titanium dioxide wherein the first coating and the one or more overcoatings have a combined thickness totaling about 0.20 mils.

2. A paperboard product according to claim 1 in which there are 1 to 2 overcoatings of a clear acrylic copolymer.

3. A paperboard product according to claim 2 in which the acrylic copolymer in said first coating and in said overcoatings is a copolymer of styrene and methylmethacrylate.

4. A paperboard product according to claim 1 which additionally comprises, on top of the overcoatings, a release coating comprising an acrylic copolymer and calcium stearate.

5. A method for minimizing the browing of paperboard when said paperboard is subjected to temperatures of up to about 205° C. which comprises applying to at least one surface of the paperboard a first coating comprising titanium dioxide and an acrylic copolymer dissolved in an organic solvent, said acrylic copolymer being about 5 to 15 weight percent of the first coating and the titanium dioxide being present in said first coating in an amount from about 15 to 35 weight percent of the acrylic copolymer in the first coating and, after drying said first coating, applying one or more overcoatings of a clear acrylic copolymer solution which is substantially free of titanium dioxide to the so coated paperboard, with a drying step between each such overcoating wherein the first coating and the one or more overcoatings have a combined thickness totaling about 0.20 mils.

6. A method according to claims 5 in which 1 to 3 overcoatings of a clear acrylic copolymer are applied.

7. A method according to claim 6 in which the acrylic copolymer in said first coating and in said overcoatings is a copolymer of styrene and methyl methacrylate.

8. A method according to claim 5 in which there is additionally applied, on top of the overcoatings, a release coating comprising an acrylic copolymer and calcium stearate.

9. A paperboard product according to claim 1 wherein said acrylic copolymer is derived from about 10 to about 90 weight percent of esters of acrylic and/or methacrylic acids with alcohols having 1 to 8 carbon atoms and a total of from about 90 to about 10 weight percent of other monomer copolymerizable therewith.

10. A paperboard product according to claim 1 wherein said first coating has the following composition:

| | |
|---|---|
| Titanium dioxide | 17 parts |
| Styrene-methyl methacrylate copolymer | 10 parts |
| Acetone | 50 parts |
| n-Hexane | 18 parts |
| Toluene | 5 parts |

* * * * *

UNITED STATES PATENT AND TRADEMARK OFFICE

CERTIFICATE OF CORRECTION

PATENT NO. : 4,421,825

DATED : December 20, 1983

INVENTOR(S) : George M. Seiter & Curtis H. Broz

It is certified that error appears in the above—identified patent and that said Letters Patent is hereby corrected as shown below:

Page 1, the second inventor is missing, after "George M. Seiter" insert -- Curtis H. Broz --.

Column 2, line 37, delete the word "carbons" and insert in lieu thereof -- carbon --.

Signed and Sealed this

*Seventh* Day of *August 1984*

[SEAL]

*Attest:*

GERALD J. MOSSINGHOFF

*Attesting Officer*

*Commissioner of Patents and Trademarks*